US008408239B2

(12) United States Patent
King

(10) Patent No.: US 8,408,239 B2
(45) Date of Patent: Apr. 2, 2013

(54) FASTENING ARRANGEMENT

(75) Inventor: Juergen King, Lauterbach (DE)

(73) Assignee: Hansgrohe SE, Schiltach (DE)

( * ) Notice: Subject to any disclaimer, the term of this patent is extended or adjusted under 35 U.S.C. 154(b) by 530 days.

(21) Appl. No.: 12/492,849

(22) Filed: Jun. 26, 2009

(65) Prior Publication Data

US 2010/0000613 A1 Jan. 7, 2010

(30) Foreign Application Priority Data

Jul. 2, 2008 (DE) ..... 10 2008 032 687

(51) Int. Cl.
*F16L 5/00* (2006.01)

(52) U.S. Cl. ..... 137/360; 137/375; 137/377; 137/382

(58) Field of Classification Search ..... 137/357, 137/360, 375, 377, 382
See application file for complete search history.

(56) References Cited

U.S. PATENT DOCUMENTS

| | | | | |
|---|---|---|---|---|
| 3,495,276 | A * | 2/1970 | Suess | 52/270 |
| 5,046,521 | A * | 9/1991 | Jensen | 137/360 |
| 5,368,065 | A | 11/1994 | Humper et al. | |
| 5,934,032 | A * | 8/1999 | Oberdorfer | 52/220.8 |
| 7,523,837 | B2 | 4/2009 | Schoenweger | |
| 2004/0050423 | A1 * | 3/2004 | Schoenweger | 137/360 |

FOREIGN PATENT DOCUMENTS

| | | | |
|---|---|---|---|
| DE | 1950667 | U | 12/1966 |
| DE | 7820423 | U1 | 11/1978 |
| DE | 4241989 | A1 | 6/1994 |
| DE | 102004014126 | B3 | 11/2005 |
| DE | 102004060744 | A1 | 6/2006 |
| DE | 20321431 | U1 | 5/2007 |

OTHER PUBLICATIONS

German Patent & Trademark Office, Office Action in corresponding German Appln. No. 10 2008 032 687.9-25, Dated Jan. 19, 2009.

* cited by examiner

*Primary Examiner* — William McCalister
(74) *Attorney, Agent, or Firm* — Duane Morris LLP

(57) ABSTRACT

A fastening arrangement for water-throughflow sanitary components in a concealed box is proposed. In a direction extending parallel to the bottom of the concealed box, the sanitary component has a distance between the ends of two mutually opposed connection stubs that is greater than the inner distance separating the through openings in the wall of the concealed box that are assigned to the two connection stubs. In order nevertheless to ensure that the sanitary component can be inserted from the open front side of the concealed box into this box, one of the two through openings is designed in such a way that it is possible for the assigned connection stub to be introduced obliquely. The connection stub is inserted into the through opening until the opposite connection stub is situated completely inside the concealed box and can then be pivoted in front of the assigned through opening. A lateral displacement then occurs such that the sanitary component is arranged centrally in the concealed box.

6 Claims, 2 Drawing Sheets

FASTENING ARRANGEMENT

The invention relates to a fastening arrangement for sanitary components.

is usual for sanitary fittings to be flush-mounted, i.e. in recesses in a wall. In this case, so-called concealed boxes are used, i.e. trough-like boxes with an open front side, pipe connections being guided through the side walls of said boxes. These concealed boxed are secured in the wall before the sanitary fittings are mounted. The sanitary fitting or a basic body of the sanitary fitting must then be inserted from the front side into the concealed box. It can then be secured in the concealed box and connected to the water pipes in the wall.

In the case of a known concealed box of this type, short pipe sections are pushed through openings in the side walls and are screw-connected into the sanitary fitting inside the concealed box and connected to the pipes outside the concealed box. The length of the sanitary fitting to be inserted into the concealed box is shorter between the oppositely situated connections than the inside distance between the side walls. This does not give rise to any difficulty when the sanitary fitting is inserted from the front side (DE 78 20 423).

In the case of another known sanitary fitting, the oppositely situated connections of a basic body of a fitting are connected to the side walls of the concealed box by inserting, into the openings in the side walls, short connecting pieces that are produced from elastomer material and abut against the outside of the connections of the basic body of the fitting. These elastomer connecting pieces bridge the radial space between the openings and the outside of the connections and the axial space between the end faces of the connections and the wall of the basic body of the fitting. In this case too, the mutual distance between the diametrically positioned connections of the basic body of the fitting is smaller than the inside distance between the side walls of the concealed box (EP 1006244).

It is the object of the invention to create a possibility of having fittings or basic bodies of fittings where the distance between the oppositely situated connection pieces is greater than the inside distance between the side walls of the concealed box.

To achieve this object the invention proposes a fastening arrangement for water-conducting sanitary components with the features given in Claim 1. Further developments of the invention are the object of sub claims.

The invention therefore proposes developing at least one opening in the wall of the concealed box such that it is possible to insert the sanitary component with its connection piece in an inclined manner into said opening from the open front side of the concealed box. As the connection pieces of the sanitary components always protrude as pipes relative to the remaining housing, it is sufficient to develop an opening in this manner. When the connection piece reaches far enough through the opening, the sanitary component can then be pivoted straight until the oppositely situated connection piece lies in front of the opening. The sanitary component can then be pushed again until the two connection pieces engage in their associated openings.

It is naturally also possible, in the mounted state, for only one connection piece to reach through the side wall, whilst the other is positioned with its end face in front of the opening, similar to that which is achieved in the prior art.

One possibility as to how such an opening can be developed so that the connection piece can be pushed through is by giving the opening an oval shape, the longitudinal axis of the cross-section thereby being directed in the direction of the open front side of the concealed box. Another possibility is to make the opening larger overall.

Whereas in the prior art the openings in the side walls of the concealed box are in the form of simple holes, in a further development the invention proposes that on the outside of at least one of the aforementioned openings the concealed box has a cylindrical sleeve, in which, with the sanitary component mounted, the connection piece associated with said opening engages. It is obviously also possible in this case for such sleeves to be mounted at both openings, and for the sanitary component to engage with the two connection pieces in the respective sleeve.

Even with such a sleeve attached to the outside, the inside opening of said sleeve with at least one opening can be enlarged or developed in such a manner as has been described above for the opening itself.

According to the invention, a further development can provide that in the mounted state of the sanitary component the two connection pieces project in the radial direction into the respective opening, in particular also into the sleeve that is integrally moulded on the outside of the concealed box and extends the opening.

There can also be cases where parts of the sanitary component are formed above or below the two diametrically positioned connection pieces such that although they do fit into the concealed box, when the sanitary component is displaced in such a manner that one connection piece is pushed through an opening further than is necessary for the subsequent end position, they come into conflict with the side wall. To this end, a further development according to the invention provides that the inside shape of the concealed box in the region of the one opening, namely the enlarged hole, is also widened outwards. These can be individual indentations for the parts that could be in the way during the displacement.

In another further development of the invention it can be provided that, to fix the sanitary component, the space between the outside of the connection pieces in their end region and the edge of the openings, in particular if these are lengthened by a sleeve, is filled out in each case by a collar of deformable material. This collar takes on the supporting, aligning and also sound proofing relating to the concealed box. With the aforementioned sleeves that are integrally moulded on the outside, the collars can be positioned such that they are subject to compression and not to shear stress as is the case in the prior art.

Further features, details and preferences of the invention are produced from the claims and the abstract, the text of both of which, through reference, is made content of the description, from the following description of preferred specific embodiments of the invention and by way of the drawing. In which:

Figure 1:
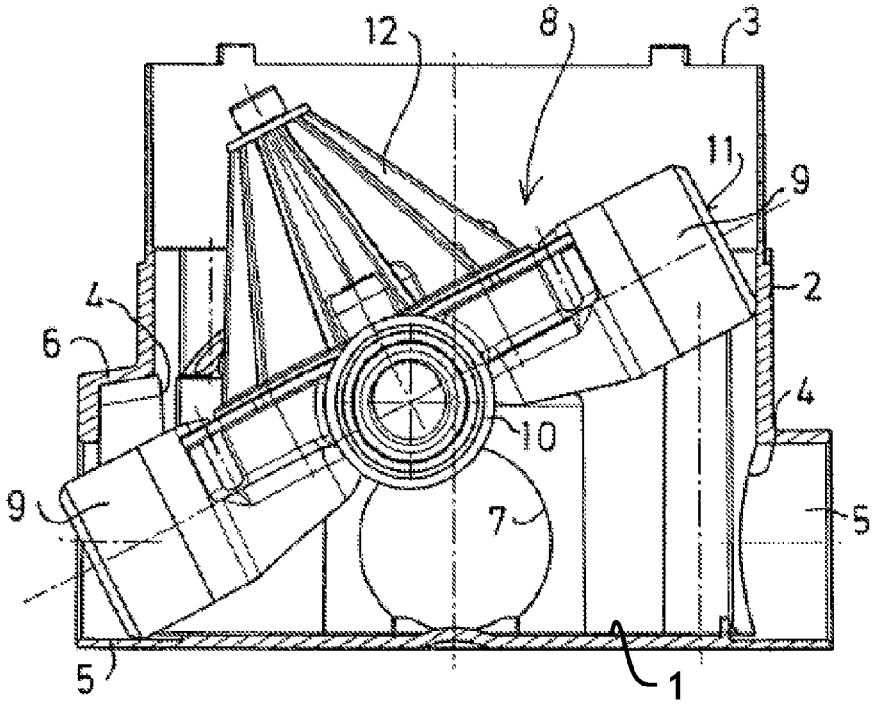
FIG. 1 is a section through a concealed box with a sanitary component at the beginning of the fastening process.

FIG. 1 shows a sectional representation of a concealed box, which is in one piece and has a bottom 1. The bottom 1 is normally fitted vertically in a wall opening on the bottom of the wall opening. From the bottom 1 a side wall 2 extends forwards, said side wall extending all around. The side wall 2 is defined by an edge 3, which extends parallel to the bottom 1 and forms the open front side of the concealed box.

Openings are formed in the concealed box directly above the bottom 1, through which openings pipe connections to a sanitary fitting are to be and can be produced. Sleeves 5 are formed connecting to each of the openings 4 on the right and left in FIG. 1, said sleeves, in the opening 4 on the right in FIG. 1, practically forming an extension to a circular opening 4. A sleeve 5 is also formed in the case of the left opening 4, the upper boundary 6 of which in FIG. 1 is at a greater distance from the bottom 1 than is the opening 4 or sleeve 5 on the right in FIG. 1. Two openings 7, of which the rear opening 7 is shown in FIG. 1, are also formed at other places on the side wall.

A sanitary component 8 that is shown in side view in FIG. 1 is to be built into the concealed box in FIG. 1. This sanitary component 8 has a total of four connection pieces 9, 10, two connection pieces 9 or 10 in each case being positioned in mutual extension and realized in an identical manner. The distance between the end edges 11 of the connection pieces 9 on the right and on the left in FIG. 1 is greater than the inside diameter of the concealed box, which has a circular cross-section. So in order to accommodate this sanitary component 8 in the concealed box, the sleeve 5 on the left in FIG. 1, with its associated opening 4, has an oval cross-section, the longitudinal axis of which extending vertically to the bottom 1 of the concealed box. This means that it is possible to insert the sanitary component 8, with the one connection piece 9 inclining forwards in the manner represented, into the concealed box, and from the position represented it is possible to push the left connection piece 9 even further through the sleeve 5 until the oppositely situated connection piece 9 can be pivoted past the inside wall as far as the bottom 1 where it then lies in front of the associated opening 4.

Figure 2:
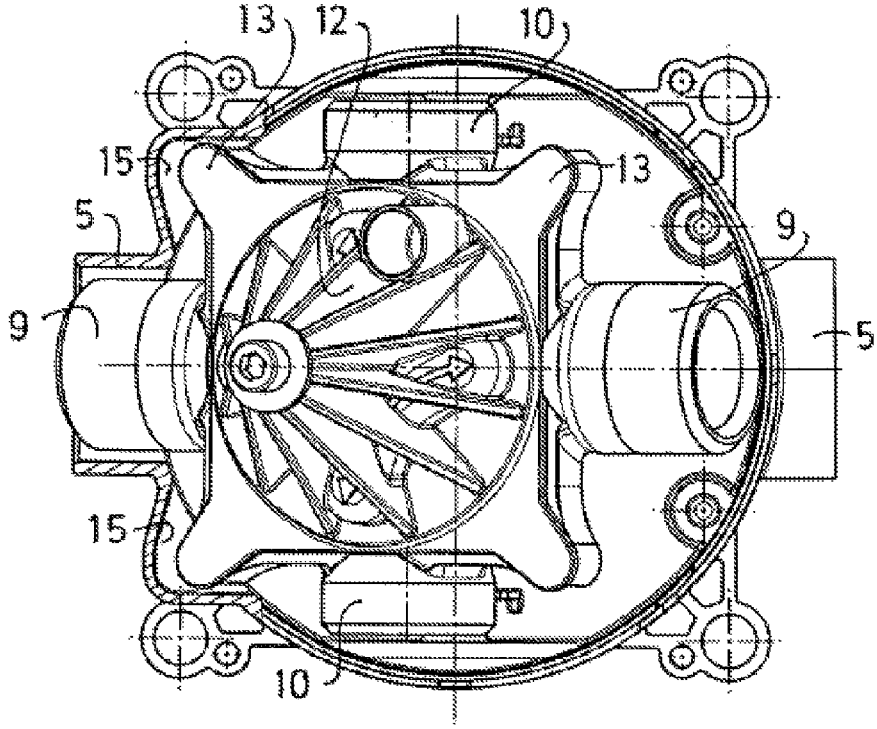
FIG. 2 is a top view of the arrangement in FIG. 1 from the open front side of the concealed box.
Figure 3:
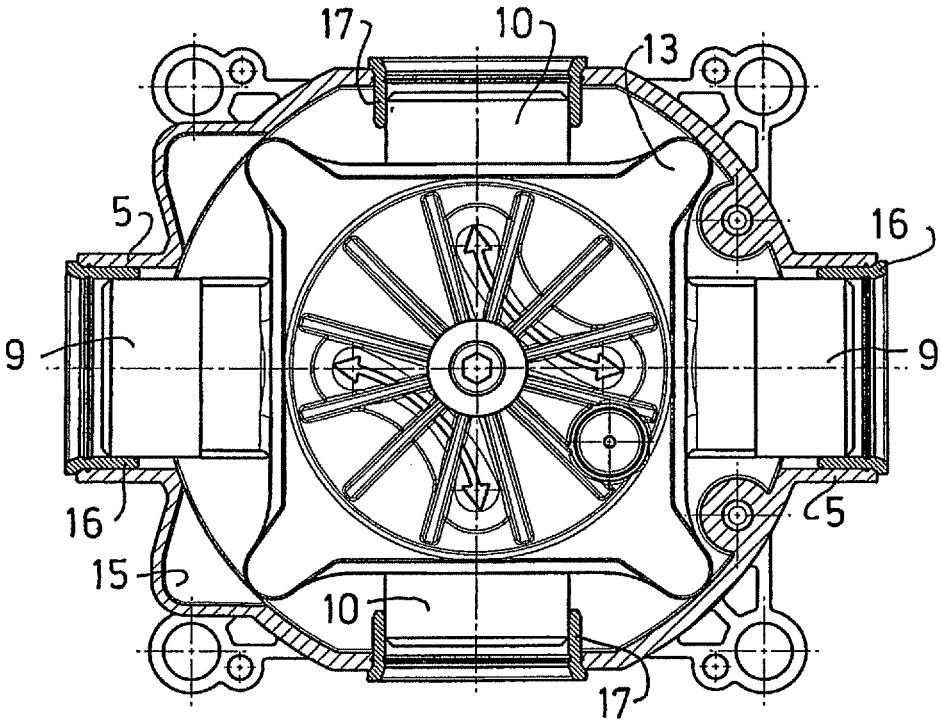
FIG. 3 is a representation corresponding to FIG. 2 after the sanitary component has been fully inserted.

The situation in FIG. 1 is also represented in FIG. 2. It can be seen in this case that a flush valve 12 is mounted on the sanitary component 8, and that said flush valve 12 together with the sanitary component 8 has four corners 13, which project slightly outwards in all four directions. To accommodate these corners 13 in the region of the enlarged, that is in FIGS. 1 and 2 the left-hand opening 4, the wall of the concealed box has two indentation 15, which correspond precisely to the arrangement and size of said extended corners 13. Consequently, from the position represented in FIGS. 1 and 2, the sanitary component 8 can be displaced a little to the left in the direction of the left sleeve 5. When the displacement has been effected far enough, the oppositely situated connection piece can be moved in front of the opening 4, and finally the sanitary component can be displaced to the right until the connection pieces 10 extending transversely relative to the drawing plane in FIG. 1, are positioned in front of their respective openings 7. With these positions then assumed, collars 16, which are produced from elastomer material and fill out the space between the outside of the connection piece 9 and the inside of the sleeve 5, are pushed into the sleeves 5 from the outside. This is represented in FIG. 3, which provides a top view of the concealed box as in FIG. 2, in this case, however, the sanitary component 8 having been pivoted into the correct position.

The two other connection pieces 10 are also secured in the associated openings 7 by means of collars 17, however, these connection pieces 10 do not reach through the openings 7.

Through the measure according to the invention it is possible to accommodate a sanitary component 8 in the concealed box, the length of said sanitary component in the one direction being greater than the inside of said concealed box.

The invention claimed is:

1. A fastening arrangement for water-throughflow components, comprising:

a concealed box which has an open front side and two mutually opposite through openings in its wall, wherein the mutually opposite through openings in the wall define an inside distance between side walls of the concealed box when mounted in a recess, a sanitary component which can be inserted into the concealed box from its front side and has at least two opposite connection stubs which are arranged in mutual axial extension and correspond to the through openings of the concealed box, wherein a distance between ends of the connection stubs exceeds the inside distance between the side walls of the concealed box in the recess, wherein at least one of the mutually opposite through openings of the concealed box is enlarged in a direction of the open front side of the concealed box relative to an associated one of the connection stubs, wherein the associated one of the connection stubs of the sanitary component is insertable into the one of the through openings that is enlarged in the direction of the open front side while the sanitary component is inserted obliquely into said one of the through openings from above, said one of the connection stubs being insertable to such an extent that the sanitary component can be pivoted into the concealed box within the inside distance, without deforming the concealed box, to bring the opposite one of the connection stubs in front of its through opening.

2. The fastening arrangement according to claim 1, wherein the concealed box has in each case a cylindrical sleeve on an outer side of said through openings.

3. The fastening arrangement according to claim 2, wherein the cylindrical sleeve of the at least one enlarged through opening has a likewise enlarged design in the direction of the open front side of the concealed box.

4. The fastening arrangement according to claim 1, wherein the two connection stubs project in the radial direction into their respective through openings when the sanitary component is in a mounted state.

5. The fastening arrangement according to claim 3, wherein an internal shape of the concealed box is widened in a region of the enlarged through opening.

6. The fastening arrangement according to claim 1, wherein a space between an outer side of the connection stub in its end region and an edge of the through openings is filled by a respective collar made of deformable material.

* * * * *